US005674323A

United States Patent [19]

Garcia

[11] Patent Number: 5,674,323

[45] Date of Patent: Oct. 7, 1997

[54] METHOD AND APPARATUS FOR CLEANING COLUMNS BY INDUCING VIBRATIONS IN FOULING MATERIAL AND THE COLUMN

[75] Inventor: Patricia M. Garcia, Houston, Tex.

[73] Assignee: American International, Inc., Houston, Tex.

[21] Appl. No.: 489,552

[22] Filed: Jun. 12, 1995

Related U.S. Application Data

[63] Continuation-in-part of Ser. No. 16,855, Feb. 12, 1993, Pat. No. 5,423,917.

[51] Int. Cl.[6] ..... B08B 3/12; B08B 9/02

[52] U.S. Cl. ..... 134/1; 134/22.11; 134/22.12; 134/167 C; 134/169 C

[58] Field of Search ..... 134/1, 22.11, 22.12, 134/167 C, 169 C, 166 C

[56] References Cited

U.S. PATENT DOCUMENTS

| | | | |
|---|---|---|---|
| 3,457,108 | 7/1969 | Hittel | 134/22.18 |
| 3,565,589 | 2/1971 | Lowe et al. | 134/22.12 |
| 4,526,623 | 7/1985 | Ishii | 134/22.12 X |
| 4,724,007 | 2/1988 | Barry et al. | 134/1 |
| 5,160,548 | 11/1992 | Boisure | 134/7 |
| 5,183,513 | 2/1993 | Sajewski | 134/22.12 |
| 5,423,917 | 6/1995 | Garcia | 134/1 |

*Primary Examiner*—Jill Warden
*Assistant Examiner*—Saeed Chaudhry

[57] ABSTRACT

A method of cleaning in a pipe which has fouling material on the interior so that the bond with the fouling material is broken by first filling the pipe with liquid, applying pressure pulsations to the liquid to the extent that a standing wave is formed in the pipe and the incompressible liquid therein, and cavitation is initiated within the standing wave in the pipe so that the pipe is cleaned on the formation of induced shock waves occurring upon collapse of microscopic bubbles resulting from cavitation and subsequent collapse.

16 Claims, 2 Drawing Sheets

PRESSURE AIR
PRESSURE AIR
PRESSURE AIR
WATER
V REG.
V REG.
P
M
V
10
11
12
13
14
15
16
17
18
20
21
22
23
24
25
26
27
28
29
30
32
36
37
38
39
40
41
42
43
45
46
48
50
51
66

METHOD AND APPARATUS FOR CLEANING COLUMNS BY INDUCING VIBRATIONS IN FOULING MATERIAL AND THE COLUMN

This disclosure is a continuation in part of Ser. No. 08/016,855, filed Feb. 12, 1993, now U.S. Pat. No. 5,423,917 issued on Jun. 13, 1995.

BACKGROUND OF THE DISCLOSURE

In virtually every conceivable industry involved in manufacturing, production or processing, fluids or gases are transported through piping, tubing, lines or other open-ended columns. These columns are of an infinite range of sizes (length and diameter) and made from a variety of materials. They are frequently straight, but more often than not they have corners, bends, U-turns, coils, spirals and such. Often piping or tubing is in sets or bundles. Often fluids or gases contact the exterior of the piping or tubing as well as the interior to cool or heat the fluids or gases. Sometimes the open ended column is exposed to the elements, and if not properly insulated, the fluids or gases which might be flowing within can be heated or cooled. Transportation of fluids and gases within the column is generally at a specified flow rate. Adverse results such as faulty operations or changes in the flow rates derive from faulty operations such as deposits collecting on the interior walls of the column. These deposits may be referred to as fouling material.

Occasionally, it is necessary to interrupt the process in order to clean fouling material from the interior of the column, to test the column or to perform routine maintenance. In a plant or factory environment, such activity generally takes place during annual or planned shutdown, a costly loss of production added to the actual cost of maintenance. Additionally, cleaning, testing, maintenance, etc. of the interior of the column may frequently be required when a shutdown is not scheduled but when there are signs of a need, such as when flow is impeded by an accumulation or build up of fouling material. In cases where piping or tubing is intended to cool or heat the interior or exterior fluids, the build of fouling material can act as unwanted insulation and degrade heat transfer. Columns also logically need to be cleaned if a different medium is processed. Where a unit is permanently dismantled, the column must be cleaned when the debris within them poses any environmental concern.

Typically at maintenance time, piping and tubing is dismantled and removed from its structure, entailing costly pipefitting, crane work etc. When piping or tubing with corners, bends, flanges, valves, etc. is involved, additional work is needed to remove them, leaving only straight sections of piping or tubing, in order to ease maintenance activities. Piping or tubing that might be bundled together are commonly left bundled together, but still most bends and such are generally removed.

Maintenance, cleaning or testing can be further complicated by the fact that the piping or tubing may be long and narrow, thus not permitting easy access. Typical cleaning methods, though only somewhat successful, include brushing with wire brushes on long rods and/or drilling into the fouling material, but severe damage to the piping or tubing may result, and such methods are very time consuming and have limited effectiveness. Sometimes chemicals are circulated through the interior in an attempt to remove the fouling material, but this is only successful when flow of selected cleaning fluids is possible and is not successful in cleaning blocked tubes or pipes. Probably the most commonly used method is cleaning by pumping high pressure water (hydroblasting) into the piping or tubing. Hydroblasting is also used for testing for leaks. These techniques impose safety and environmental concerns and are only somewhat effective.

One prior technique uses a single valve, pressure based annular jetting system as described in U.S. Pat. No. 4,724,007, which is based on pushing a pig through a tube under high pressure. The patent states "It is now thought that the initial breakdown is not necessarily due to sonic energy and that what might have been sonic energy is more likely to be some mechanical effect akin to the effect produced in water hammer. Furthermore, at the temperatures over the time scales used, the polymer breakdown discussed by Boundy and Boyer is unlikely to occur." Pressure based annular jetting or pigging has failed at actually cleaning tubes either in the field or in public demonstrations and therefore, like brushing, drilling and hydroblasting, is also not a successful alternative. The description of annular jetting in the patent expresses many unknowns. The presence of many unknowns contribute to a system which is difficult or impossible to control.

The methodology described in the following disclosure, referred to herein as hydrokinetics, has distinct differences from the annular jetting system (cleaning by pigging using water hammer shock waves), where one major difference is that the annular jetting system is based on pushing or hammering a pig through a tube while hydrokinetics induces a sonic, subsonic or supersonic resonance (hereinafter called "sonics") in a tube or pipe for cleaning purposes. No pig is used with hydrokinetics, but in instances where the pipe is not completely blocked with fouling material, a blockage may be inserted in the pipe. This blockage can be anything of sufficient size and texture to close off the diameter of the column, such as paper toweling, polyethylene sheets, foam, rubber, etc. This blockage is helpful for the induction of sorties and is not pushed through the pipe. In the event of a solidly fouled pipe, no manually inserted blockage is necessary since the fouling material serves as the blockage. The blockage often is blown from the pipe before or with the fouling material, unlike the pig in annular jetting which is blown along the robe behind the fouling material which the pig is pushing. Further the blockage device is proportioned to the size of the pump used. With a smaller pump, tighter clearance around the blockage is used. The sonics apparently acts on the downstream edge of the blockage where the fluid stream flows around it. With annular pigging, the effect is on the back of their pig where force is applied.

The pig used in annular jetting is relatively incompressible to be able to push the fouling material. The blockage device used in hydrokinetics may be incompressible or not. Compressible paper toweling or wadded plastic may be used so long as it provides a blockage. No pig launcher is needed. No pig catcher is needed.

Another primary difference is that annular pigging is comprised of applying a very rapid pressure increase as one end of a pig whereas hydrokinetics (as hereafter described) is based on slow filling of the pipe, and then release of high velocity fluid into the relatively static fluid in the pipe. Because annular pigging involves very rapid pressure build up, the method is limited to pressures below the tensile yield of the pipe or the pipe will burst. Hydrokinetics does not have this limitation. It is believed that the pipe is not subject to the actual pressure, only the created resonance.

Another primary difference is that annular pigging requires maintaining pressure on the pig for a sufficient time to force the pig completely through the tube. This hydrokinetics process is based on rapid release of fluid for only long enough to create the sonics surge into the aforementioned static fluid with no regard for forcing any projectile along the pipe.

One similarity is that both methods use a cylinder multi positive displacement pump. However with hydrokinetics it is desirable that a positive displacement pump include an odd number of cylinders. With a pulsating device downstream from the pump or fluid pressure source, any type of pump capable of producing the needed pressure can be used.

One significant difference is that annular pigging requires only a single valve to cut the fluid stream off and on. Hydrokinetics is a more involved method which uses at least two valves in addition to an unloader valve to induce resonance into the water in the pipe. This cannot be done with only a single valve.

Pigging primarily forces the pig violently into contact with the fouling material. Pig blockage devices in this hydrokinetics method does not by violent contact the fouling material. Pigging movement is so violent that water hammer and shock may occur. However, hydrokinetics induces sonics in the water of the system upstream of such blockage, at the very beginning at the pump or pulse generator operation and is enhanced by all the accelerators.

Sometimes shock from the violent contact of the pig and the fouling material in the annular pigging process may alter the contaminant material or its bond to the tube wall causing the material to change particulate or granular form. Hydrokinetics acts on contaminant material bond on the tube and the material is not changed from its particulate or granular form; rather the form is not altered. Fouling material expelled generally is large sections and has the same form prior to cleaning.

With annular pigging, successively repeating the process is desirable as layers of deposits are removed, using pigs of successively larger diameter, evidencing that the bond of the fouling material to the tube wall is not fully broken. Hydrokinetics breaks the cohesion or bond between the pipe wall and the fouling material, thus removing the entire mass of fouling material. Obviously the fluid stream may wash loose or easily removed fouling material out of the pipe.

In annular pigging, minor leakage around the is desirable. With hydrokinetics, leakage is avoided because it disrupts the laminar flow as hereinafter described.

With hydrokinetics, pigging does not take place while a blockage is manually inserted when the fouling material does not totally block the tube. This blockage device is not a scrapper. With annular pigging, the pig emerges from far end of the tube normally undamaged. With hydrokinetics, the blockage device is often distorted, probably due to the sonics and high velocities. Groves are formed along the side of the blockage devices, apparently made by scrapping the pipe wall. On close examination, it appears that the groves are back to front, negating scrapping. It is believed that these groves are the byproducts of cavitation around the blockage device.

This disclosure sets out a methodology and associated apparatus for the induction of a sonic, subsonic or supersonic resonance in the interior diameters of columns, pipes, tubes, lines, ducts, conduits, hoses, catheters, funnels and similar structures whether cylindrical or not, including stock which is square, star-shaped, round or triangular in cross section (such tubing or pipe hereinafter referred to as "pipes"). The present methodology system is a valved multi velocity based sonic system, whereby sonic frequency is induced along the water filled column. This sonic shock may be used to break the cohesion between fouling material and the pipe wall so the fouling material is washed away in the liquid in the pipe. This is in contrast to annular jetting systems which remove successive layers of fouling materials, usually layer after layer. The disclosed hydrokinetic system, when used for cleaning, generally removes 100% of the fouling material even where it has several layers. Unlike annular pigging systems, the system is effective on any type of fouling material which will respond to the induced sonics, not just large polymeric molecules of repeating monomers or co-polymeric (involving two or more monomers) fouling material exemplified in U.S. Pat. No. 4,724,007. For instance, in a dairy, hydrokinetics can remove butterfat buildup in lines, or in a plant using sea water, hydrokinetics can remove clams clinging to the interior of the lines. This is not a pressure surge water hammer system common in the pressure based annular pigging system.

To induce a sonic wave into a pipe via this hydrokinetics process, a pump or other high pressure fluid source, an unloader valve, fluid accelerator(s), two valves and a ram and nozzle assembly are used. A lance is not a required part of hydrokinetics. The fluid source may be smooth or pulsating, for example an odd numbered, multi cylinder positive displacement pump such as a triplex pump. The fluid source can connect to a pulsation source downstream to add pulsations to the fluid flow. In the series of valves, one must be a normally closed bypass valve plumbed into the system to facilitate it valve opening during bypass mode. The pipe is often entirely blocked with fouling material at some point along the length of the pipe. If the fouling material does not block the flow, a plug is placed in the pipe to emulate such a blockage.

In brief, hydrokinetics entails the delivery of a fluid stream from the pump or other fluid source into columns, piping, tubing, lines, ducts, conduits, hoses, reeds, catheters, funnels, and/or other open-ended columns (again, hereinafter referred to as "pipes") via apparatus which creates sound waves in the fluid system and which are transferred to the bond of the fouling material. Being of different materials, the wall of the pipe and the fouling material resonant at different rates, breaking the bond between the two. Once the bond is broken, the fouling material washes out in the fluid stream. Since the system is not dependent upon erosion or scrapping of the fouling material, it is likely that 100% of the fouling material will be removed.

BRIEF DESCRIPTION OF THE DRAWINGS

So that the manner in which the above recited features, advantages and objects of the present invention are attained and can be understood in detail, more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

Figure 1:
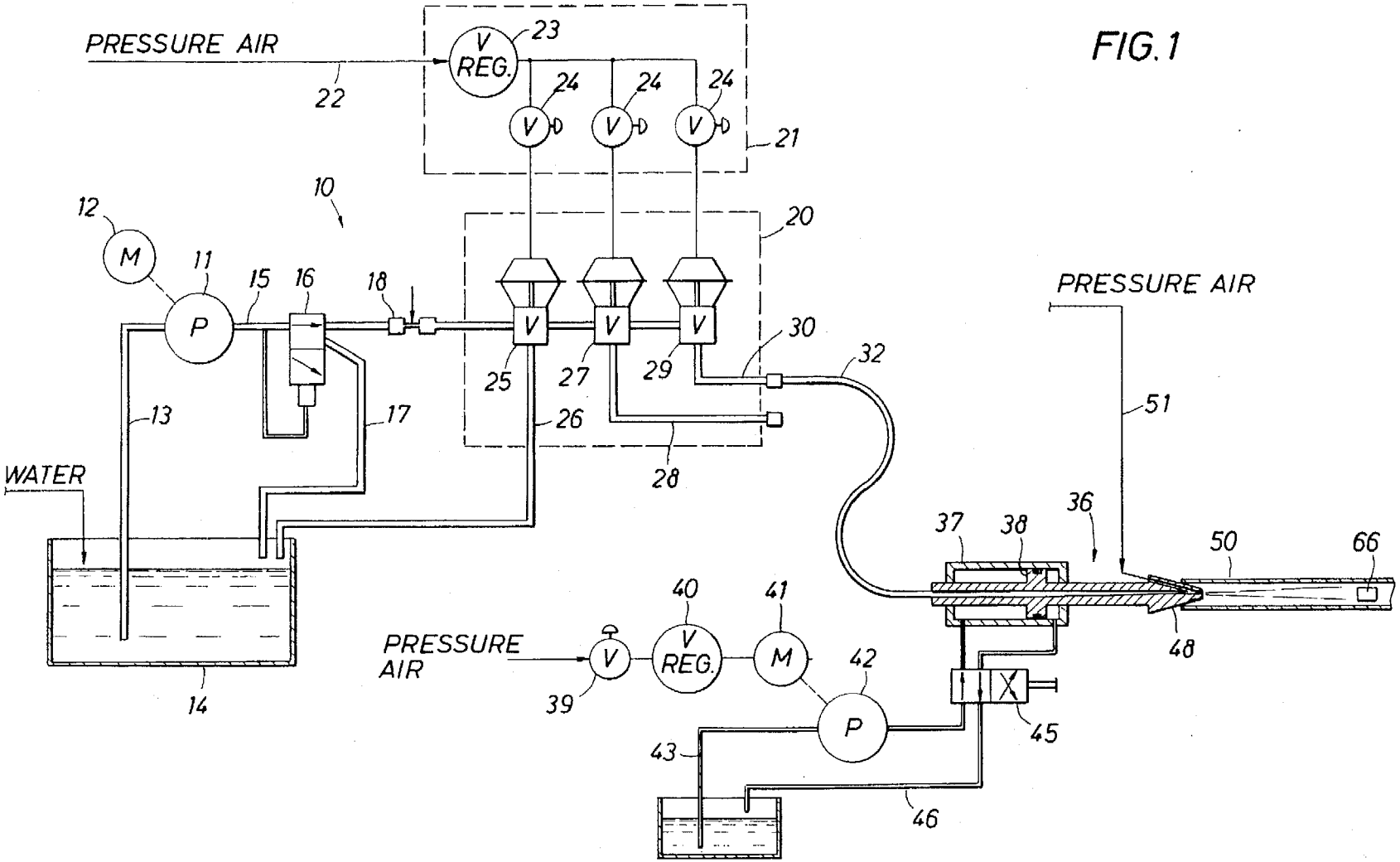
FIG. 1 is a schematic flow diagram of the system forming a shock wave as set forth in the present disclosure and shows in a combined schematic the fluid flow of air and water in the system.

According to the article, "The Chemical Effects of Ultrasound", *Scientific American,* February 1989, large bubbles or cavities, imploded by water pressure are a source of vibrations. The process will be herein referred to as "cavitation". Intense ultrasound waves generate large alternating stresses within a liquid by creating regions of positive pressure and negative pressure; a cavity can form and grow during the episodes of negative pressure but when the cavity attains a critical size, the cavity implodes, generating intense heat and tremendous pressure. More specifically, the article suggests that vibrations are due to the tremendous turbulence, heat and pressure of the imploding cavities, providing a unique environment for high energy reactions. Cavitation can be induced by generating intense sound waves in a liquid. Such waves create alternating regions of compression and expansion that can form bubbles subject to implosion. Of course, compression cycles exert a pressure on the liquid molecules forcing them together. Conversely, expansion cycles exert a negative pressure which pulls the molecules away from one another. According to the article, "During the expansion cycle a sound wave of sufficient intensity can generate cavities."

A liquid is held together by attractive forces, which determine surface tension of a liquid. For a cavity to form, a large negative pressure associated with the expansion cycle of the sound wave overcomes the liquid tensile strength. The article explains that less pure liquids have weaker tensile strengths. Thus the induction of soda or a metalliferous medium, as described hereafter, enhances the formation of cavities. Further, the adhesive nature of a liquid is cut when the liquid is gas cut, or gas is dissolved in the liquid. "When a gas-filled crevice is exposed to a negative-pressure cycles from a sound wave, the reduced pressure makes the gas in the crevice expand until a bubble is released into solution. Most liquids, such as tap water, are sufficiently contaminated by small particles to initiate cavitation."

According to the article, bubbles in liquid are inherently unstable (large ones tend to float to the surface and small ones tend to redissolve into the liquid), but bubbles absorb energy with the compression and expansion cycles of sonic waves. "The growing cavity can eventually reach a critical size where it will most efficiently absorb energy from the ultrasound. The critical size depends on the frequency of the ultrasound wave. Once a cavity can no longer absorb energy efficiently from the sound waves, it can no longer sustain itself and the liquid rushes in and the cavity implodes."

During implosion, the gases and vapors inside the cavity are compressed, generating intense heat that raises the temperature of the surrounding liquid, creating a very small local hot spot which dissipates quickly. However, at any given time, the temperature of the bulk of the liquid remains unaffected.

Further according to "The Chemical Effects of Ultrasound", *Scientific American,* February 1989, if the cavity forms near an extended solid surface, such as the surface of the fouling material or pipe wall, the implosion will be asymmetric, expelling a jet of liquid at roughly 400 kilometers per hour directed at the surface, as the jet develops opposite the solid surface and moves toward it. The jet, as well as the waves from the cavity implosion, erode solid surfaces, remove non-reactive coating and fragment brittle powders. Reactions are further facilitated by high temperatures and pressure associated with cavity implosion near the surface. Thus it is believed that in the hydrokinetic system (as described in detail in the following paragraphs), in conjunction with the resonance of the fouling material and pipe wall at different frequencies, degradation of the fouling material and deep cleaning of the pipe wall surface is further impacted by the bombardment of high-speed jets of heat and energy for the imploding cavities. Hydrokinetics is effective at clearing fouling material from pits in the pipe wall, an effect very important during pipe testing.

FIG. 1 of the drawings illustrates the schematic of the system having a pump 11 which is driven by a suitable motor 12. It is provided with a feed line 13 from a water sump 14.

The pump 11 has a pump output 15 which is provided to a control valve 16. The valve 16 is a two position valve. In the illustrated position, water under pressure is delivered from the pump through an adjustable orifice 18. The valve 16 also connects with a line 17 which provides a return to the sump. The orifice 18 provides an input to a control cabinet 20 represented in dotted line for operator control.

The control cabinet has an air pressure manifold 21. There is a supply of pressurized air on a line 22 which is input to a regulator valve 23. That provides a regulated air pressure output through several control valves at 24. The several regulators are input to water control valves in the cabinet 20. The first valve 25 is connected with a line 26 which provides another return to the sump. The valve 25, when operated, delivers the output flow through a control valve 27. It connects with a flow line 28 for purposes to be described. In addition, flow is delivered to a valve 29 which provides an output flow that is switched when the valve 29 is operated. This output is on a line 30. The cabinet 20 has appropriate fittings on it to enable connection of a lance feed line 32. The line 32 extends some distance, typically from 10 to 50 feet.

The lance 36 is coaxial with an elongate cylinder 37 which encloses a piston 38. The piston 38 enables positive insertion and retraction of the lance. The hydraulic system thus utilizes air from a suitable air pressure source delivered through a control valve 39 which connects to an air pressure regulator 40. An air motor 41 operates a hydraulic pump 42. There is an inlet line 43 connected to hydraulic oil sump 44. Hydraulic oil is delivered to a control valve 45 to control the movement of the lance. The return line 46 returns the low pressure oil to the sump. The lance has an elongate rod portion which terminates at a tip 48. An air inlet line 51 connects with the lanced tip 48 to introduce air along with the liquid.

Figure 2:
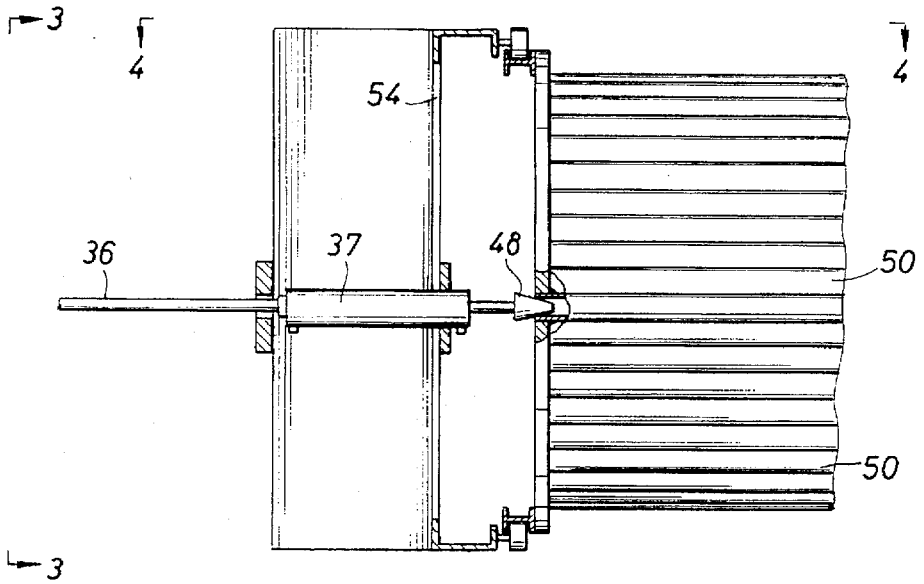
FIG. 2 is a side view of a lance mounting mechanism showing a lance which extends to seat against a tube to enable tube cleaning.
Figure 3:
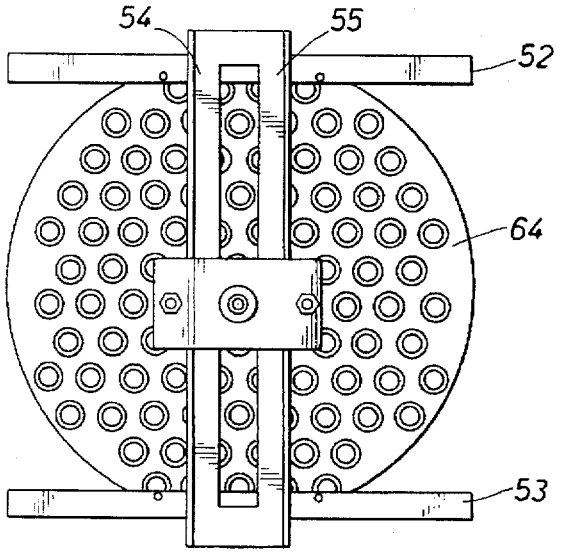
FIG. 3 is a sectional view along the line 3—3 of FIG. 2 and shows details to construction of the mechanism which aligns the lance with a particular tube for cleaning.
Figure 4:
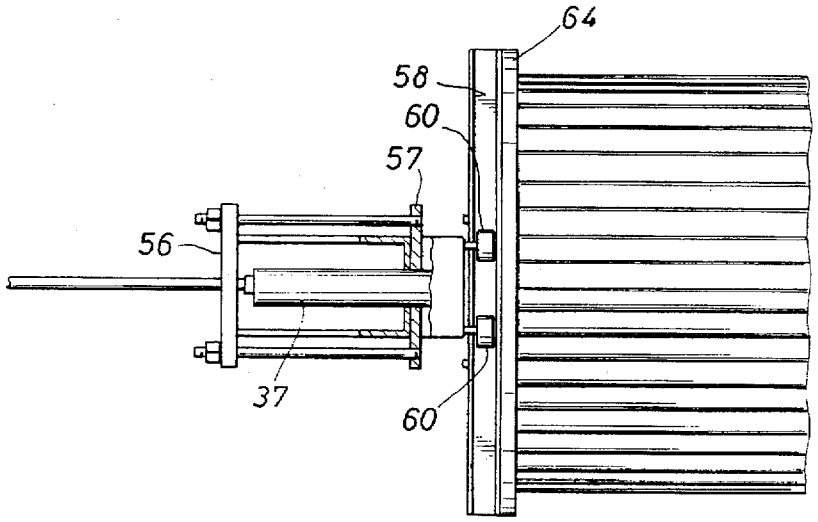
FIG. 4 is a sectional view along the line 4—4 of FIG. 2 showing details of construction of the lance insertion mechanism.

The lance 48 is moved with respect to a set of tubes in a fashion shown in FIGS. 2, 3 and 4. FIG. 2 shows the lance 36 which is supported and aligned by cylinder 37. It is mounted so that it travels on a pair of parallel rails 52 and 53 shown in FIG. 3 of the drawings for movement in the X direction. A bracket is comprised of left and right frame members 54 and 55. They move as a unit. They enable vertical movement of the cylinder 37. The frame members 54 and 55 define a gap where the lance extends through the gap. The cylinder 37 is anchored to the spaced plates 56 and 57 which capture the cylinder. The guide surfaces are formed along the edges of the frame members 54 and 55 and thus define the channel 58 shown in FIG. 4 for movement. Rollers 60 are located in this channel.

The cylinder 37 is ,guided by the rollers 60 which clamp on the outside of the parallel frame members 54 and 55. In cleaning the tubes, the device 66 is first placed in a tube and the lance is moved in an X and Y coordinate system until it is aligned with the particular tube.

To initiate this process, any source of fluid to be fed into the system can be used so long as it is sufficient to supply the quantifies needed. Such source might be municipal fire water, plant or factory water or a portable tank containing a liquid chemical appropriate for the need. Such fluid may be pumped continuously or as needed into the holding tank for the pump, which is a pump of any type that delivers the fluid in pulsations, such as a positive displacement pump, rather than flow in a steady stream, such as a centrifugal pump. The pump is sized as close as possible to the maximum flow rate allowed for a given pipe, generally measured in gallons per minute (gpm). With the addition of a pulsating device downstream from the pump or fluid source, any type of pump capable of producing the needed pressure range can be used or, if the fluid source itself is capable of producing the needed pressure range, no pump at all is needed.

Operating pressures for hydrokinetic action range up to 20,000 psi with the typical range being about 250 to 3000 psi. This system is not a pressure intensive system. Rather the pressure serves key purposes (1) to move the resonating fluid system, (2) to wash the fouling material from the pipe once the cohesion between the pipe wall and the fouling material has been broken, or (3) to test pipe.

The fluid stream travels from the pump or pulse generator to an unloader valve, which is a very precise, adjustable, fast acting pressure relief device. When a defined pressure is exceeded at this valve, it dumps enough fluid to drop the pressure of the stream down to a targeted pressure. This unloader valve 16 is constantly regulating the pressure in a rapidly pulsing fashion to maintain this given pressure profile. The unloader valve increases the pulses produced by the pulsation type pump or device. This increase in pulsations can be calculated for precise control of the system but calculations are not required for effectiveness.

From the unloader valve the fluid stream is routed to a fluid accelerator, which is usually the first of two or more fluid accelerators, and then routed to the next accelerators are appropriate for the project, on to more accelerator(s). It is possible that only one high quality accelerator will achieve the velocity needed for sonic cleaning, but more than one is usually needed to reach the necessary velocity. One simple accelerator is the orifice 18 to increase the flow velocity. The purpose of the accelerator(s) is to increase the velocity of the fluid stream beyond the velocity normally generated by the pump or fluid source.

The fluid flows through hoses or piping to a safety control cabinet containing two or more valves. Unlike annular jetting systems which rely on one valve to simply cut the fluid stream off and on, this hydrokinetics process uses this multi valve set up to create the resonance into the "unit" (a "unit" is one pipe, a set of pipes or an entire bundles or network of pipes). These valves are (1) the bypass valve, (2) the line-out valve for activity involving one unit and (3) any number of additional line-out valves for activity involving multiple units. When open, the bypass valve, which is normally closed, routes the fluid stream to a drain or holding tank, or when a pump is used, will re-route the fluid back to the holding tank as the pump. It is recommended for safety but not necessary for functionality that all valves be spring loaded and configured in such a way as to always go into bypass mode in the event that air pressure is lost or if operator intervention is lost.

The safety control cabinet is best as one enclosure which contains the bypass valve and line-out valves as well as the necessary gauges and controls, or can mean an enclosure for the valving with a separate enclosures for the gauges and/or controls. The enclosure or walls of the safety control cabinet can be 316 stainless steel or other appropriate material designed and constructed in such a manner as to form a safe, preferably explosion-proof enclosure that will contain and disperse the pressures generated in the valve oscillator in the event of failure, disconnected couplings, etc. This enclosure can also serve as a NEMA (electrically safe) enclosure if it is preferred that the components of the system be controlled by electric power. Enclosure weight is reduced by omitting the frame, and the walls of the enclosure form its own frame, thus allowing mounting the components to the cabinet.

The suggested monitoring panel of the safety control cabinet has a high pressure output gauge, a hydraulic pressure gauge, an air pressure gauge and other appropriate instrumentation. These in some instances are also enhanced by LED signals showing the position of the pilot valves (defined hereafter).

The operation of the hydraulic systems in the safety control cabinet is controlled by a set of two-way pneumatic pilot valves. The pilot valves 24 are energized by high pressure air from a source of at least about 100 psi. In the event 100 psi air is not available at a given location, an additional component of the system, known as an air-to-air intensifier, is utilized to bring air pressure to a selected level. In the event that air pressure exceeds 140 psi, a regulator is utilized to bring the air pressure down to the specified air pressure.

Control levers on the safety control cabinet actuate the pilot valves. The pilot valves actuate the bypass and line-out valves. The inlet sides of the pilot valves are connected, usually by high pressure hoses and fittings, to an air manifold attached to the regulator, if required, which is attached to the safety control cabinet which is attached to the air source. The outlet sides of the pilot valves are connected to a diaphragm actuator which activates the bypass and line-out valves. When energized, air is directed from the air source to the top of the diaphragm, which pushes down upon a plunger, which activates the bypass valve and the line-out valve. When in the de-energized position, air that was used to push against the diaphragm is allowed to flow back through the connecting hose and is exhausted via a port in the pilot valve to an exhaust outlet located in the side of the safety control cabinet.

Within the safety control cabinet, there is a high pressure fluid oscillator block and valves. The oscillator block is constructed of a material such as carpenter grade high tensile stainless steel or high alloy steels (for use with highly chlorinated water as a fluid stream). This oscillator might be cylindrical in cross section and should have a wall thickness sufficient to handle triple the maximum pressure from the pump or fluid source. This oscillator block is mounted to the cabinet to allow it to vibrate freely.

The bypass valve and the line-out valves are poppet valves. They are actuated by the pneumatic actuators described above. The inlet side of the oscillator is connected to the system via hoses or pipes. The outlet side of the oscillator is two phase. In the bypass mode, when the line-out valve is closed and the bypass valve is open, the bypass valve allows fluid to circulate through the oscillator at low pressure and back to the holding tank or drain. A heavy wall high pressure pipe can be attached to the bypass outlet so that additional vibrations or harmonics can be induced in the system by adjusting the length of this pipe.

Staging mode is the mode of the procedure that prepares or stages the system for resonance into the fouled pipe or pipe to be tested The line-out valve and the bypass valve are both open, allowing low pressure fluid to fill the pipe up to the point where the pipe is blocked with fouling material. In the event the fouling material only partially blocks the flow of fluid, a blockage device is added in the pipe. This blockage may simply be a wad of paper, plastic, foam or other such object, and it is often a plastic or brass plug, which appears at first glance to be a pig as used in the annular jetting method. However, its purpose is to act as a plug, not to be driven through the pipe as the cleaning device. There is not a rapid inflow of fluid as in the annular jetting system, but simply a filling of the pipe. The blockage of fouling material collects debris which washes out in the fluid stream under the pressure inherent to the system, leaving only a partial blockage, or plug which must be placed in the pipe.

Operational mode is the mode of the procedure in which the pulsations are transferred via the fluid stream (which has already filled the pipe) via a nozzle (the nozzle is described hereafter) to the pipe. In this mode the bypass valve is closed. Because this valve is closed and because the pipe is blocked either by fouling material or a plug, and thus no fluid is allowed to escape anywhere in the system, pressure builds throughout the entire system, from the fluid source forward all the way to the blockage. The line-out valve is still open in the operational mode. As pressure builds in the oscillator (as described above) of the cabinet, the oscillator and the fluid within will begin to vibrate. This mode may only last a fraction of a second, after which the bypass valve is reopened.

There is of course a frequency at which the pipe, dependent upon its composition, will begin to vibrate and a frequency at which the fouling material, dependent upon its composition, will begin to vibrate. Composition for these purposes is as size, thickness, density, support structure and other criteria which control the frequency at which an item will vibrate. Because the pipe and the fouling material are of different compositions, they will almost always vibrate at different frequencies, except in the rare instance where both the pipe and the fouling material vibrate at the same frequency. When the frequency at which each will vibrate is met in the fluid stream by the build up of pressure in the pulsations, from the pump or pulse generator, this frequency will result in the vibration of the pipe and separately in the vibration of the fouling material. This separate vibration results in a breaking of the bond between the pipe wall and the fouling material. Once this cohesion is broken, the blockage which inhibited the flow of the fluid stream will wash forward under the pressure inherent to the system and the blockage and other fouling material will wash out of the pipe. Then, it is extremely easy to remove fouling material, debris is washed out with a simple garden hose, or which is washed under the pressure inherent to the system.

This system cleans when the necessary frequency range does not exceed an augmented frequency range, such as the frequency range arrived at from the 120 degree pulsation of a triplex pump when the pump rotating at approximately 450 rpm and modulated through the unloader system at a pressure low enough to avoid structural damage to the fouled pipe. In the event that the frequency range needed to induce a resonance in the pipe exceeds the normal operating capabilities of the hydrokinetic system, the frequencies can be raised further via manipulation of the bypass and line-out valves, in the following manner.

The line-out valve is closed after the pipe is filled with fluid. Bypass valve is closed. Pressure is allowed to build in the oscillator block. This pressure is modulated into the already filled tube via manipulation (rapid off and on) of the line-out valve. Much higher pressures and higher frequency ranges can be achieved and transferred to the pipe wall without causing structural damages via sympathetic vibration. In the event that still higher modulation might be required, this is achieved in some instances by the insertion of a vibrating reed into a holder affixed at the inlet side of the high pressure oscillator and/or the aforementioned vibrating reed is attached to the outlet side of the bypass valve. Fluid moving at a high velocity across the top of the reeds causes the reeds to vibrate. The thickness and length of the reeds determines their vibrational frequencies. Another method of achieving the same effect is the utilization of an eccentric cam rotated by a motor.

Additionally, sound frequencies can be fed into a static stream via a tone generator or oscillator. This oscillator can also be automated. A computer program can instruct the tone generator to give out a modulating frequency with a preset low frequency and high frequency range. The high and low frequencies are determined by attributes of the pipe (such as the material of construction, length, diameter, and wall thickness) and attributes of the fouling material. As the tone generator sweeps between the preset low and high frequencies, a standard frequency analyzer mounted on the back of the pipe will pick up and lock onto the actual frequency at which the pipe will resonant. The information can be fed back to the computer and the computer can lock the tone generator onto this frequency, allowing resonance of the pipe without regard to the pressure generated by the pump or fluid source.

When the system is in the Operational mode, the fluid stream travels, as described above, through the line-out valve to the pipe via tubing or hoses. At the face of the pipe, to inject the fluid stream into the pipe, a ram and nozzle assembly is used. The ram is mounted at the face of the pipe or set or bundle of pipes to allow hydraulic, electronic or manual movement of the nozzle in and out of each tube. It is recommended for safety but not required for functionality that a check valve be plumbed in the hydraulic line, so that once the ram is energized with the nozzle against the face of the pipe, if hydraulic pressure is lost, the ram and nozzle assembly will not come away from the pipe face until such check value is manually tripped. The ram is coaxial (moves forward and backward) with an elongate cylinder which enclosed a piston. It is unique in that it has a tapered bore and the fluid runs through the piston rod, eliminating the need for additional pipe firings. The taper of the bore is such that the orifice at the outlet of the ram is approximately 15 to 20% smaller than the orifice at the inlet of the ram. As a safety mechanism, at the inlet side of the ram, a machined bell nipple connects to a coupling on the hose to the ram. In the event of any type of failure of this coupling, this bell shape acts as a diffuser to remove the energy from the fluid stream to protect personnel.

The nozzle is tapered with the outlet end, usually smaller than the inlet end of the pipe. In cases where pipes are "rolled" into pipe or tube face sheets, the taper on the nozzle preferably is the same as the taper used on the rolling tool which rolled the end of the pipe onto the face sheet; thus the nozzle will reinforce this roll rather than doing damage to it. When the nozzle is inserted into the pipe and hydraulic pressure is applied via the ram, a tight metal-to-metal seal is formed between the nozzle and the pipe. This is in contrast to the desired leak needed in an annular jetting system.

Between the ram and nozzle, a nozzle adapter can be inserted. The nozzle adapter is a measured orifice machined to avoid protrusions into the fluid stream where it attaches to the ram and to the nozzle, so that the flow is laminar. The bore in the nozzle adapter is the same diameter as the bore at the outlet end of the ram, thus not increasing or decreasing the velocity of the fluid stream. Onto this nozzle adapter, a heavy duty, thickwalled, highpressure pipe can be attached. The purpose of this pipe is to add length in order to induce more harmonics into the fluid stream. If the pipe is longer, the vibration is greater.

To support the ram, nozzle adapter and nozzle, against a bundle of pipes, an X-Y alignment system can be used. This is a device such as used in laser burning, machining, cutting, etc. The X-Y axis can be freestanding or mounted to the face of the pipe bundle. The ram and nozzle assembly are moved along the X or Y axis manually or a computer automatically moves the ram and nozzle assembly along the X or Y axis upon command. This requires programming on mechanisms such as those used to move lathes, mills, drill presses, etc. This would facilitate the use of Hydrokinetics in environments where manual movement would be difficult or prohibitive, such as in nuclear waste processes.

It is an important, but not necessarily an essential part of the hydrokinetic system, that the flow of fluid, from the pump or fluid source to the upstream side of the nozzle, be as streamlined as possible. Protrusions into the fluid system, such as a bolt protruding through the line into the fluid stream, or by high friction internal linings of the pipes are avoided. The flow of the fluid stream is as "laminar" as possible. This is opposed to a "boundary layer flow" in which the outer portion of the radius of the stream is slowed by frictional drag and flows at a slower velocity that the inner portion of the stream, or turbulent flow.

The fluid stream changes from laminar flow to boundary layer flow at the outlet nozzle tip. In the pipe to be cleaned, filled with static fluid from the nozzle tip, a pulsating fluid stream pumped into the center of the pipe, sets up a reflected shock wave and resultant standing wave in the column of water. The standing wave frequency will pass through the resonance frequencies of the fouling material. The fluid is thought to collapse bubbles during the low pressure pulse resulting in cavitation. In addition to the breaking of the cohesion between the pipe wall and the fouling material, loose or easily removed fouling material simply washes out in the fluid stream while the cavitation breaks the fouling material bond which becomes loose and washes free.

To enhance the boundary layer flow at the outlet of the nozzle tip, a high pressure air manifold connected to the nozzle adds measured pulses of gas to the fluid stream, enhancing the cavitating effect.

In some situations, it may be faster and provide a higher degree of cleanliness or polishing, to add soft abrasives, such as sodium bicarbonate or polymers, to the fluid stream. Soft abrasives and other mediums can be added wet or dry. Dry materials, such as various bicarbonates, are injected at the nozzle into the static fluid used to fill the pipe during the Staging ,mode or into the resonating fluid stream during Operational mode. Upstream of the first accelerator, part of the fluid stream from the pump or fluid source can be mixed with the medium to be injected. The abrasive material is blended with part of the fluid stream and the solution is added into the main fluid stream downstream. The controls needed for dry or liquid medium injection are pneumatic metering valves. A liquid surfactant or cleansing agent can be added.

According to the article, "The Chemical Effects of Ultrasound", solid particles, such as soda or the metallic elements in a metalliferous medium, are heavily impacted by the effect of waves caused by cavitation of bubbles when sonics are induced in a liquid. (discussed in more detail hereafter). Apparently, the pressure waves drive small particles into one another at high speeds with collisions so intense that the metal powders are melted at the point of impact. This melting can remove metallic-oxide coatings, which protect the metals. Concluding, the article says "Ultrasound can increase the reactivity of metal powders by more than 100,000 time", which appears to cause metal particles to bond. Thus the addition of soda or chemicals of a metallic nature can enhance the cleaning.

The intensity of cavity implosion can easily be altered by changing frequency, acoustic intensity, temperature, static pressure, choice of liquid and choice of gas. In the article, implosion proceeds more slowly as ambient temperature increases so the fluid stream can be cooled to enhance cleaning. The fluid stream can be warmed to reduce cleaning.

Tests have shown hydrokinetics to be particularly effective for removing hydrocarbon based deposits. According to the article, organic compounds are highly degraded in this environment, and inorganic compounds can be oxidized or reduced.

While the foregoing is directed to the preferred embodiment, the scope thereof is determined by the claims which follow:

What is claimed is:

1. A method for cleaning a fouled pipe comprising the steps of:

(a) filling the pipe with an incompressible liquid;

(b) releaseably connecting to the pipe a pressure source;

(c) by means of cooperating valves, pulsating the pressure source to form a standing wave in the liquid in the pipe;

(d) by means of said valves, adjusting said pulsations so that cavitation occurs in the liquid during pressure fluctuations within the standing wave; and (e) by means of said valves, adjusting the pressure of the pulsations such that said cavitation creates vibrations of differing frequencies transmitted through the liquid to the fouling material and to the pipe, wherein the fouling material and the pipe vibrate at different frequencies to break the fouling material free of the pipe.

2. The method of claim 1 wherein the pipe is constructed with an inlet end and an outlet end, and the pressure pulsations are delivered into the pipe at the inlet end.

3. The method of claim 2 wherein the outlet end of the pipe is plugged by a blocking device, and wherein the blocking device is temporarily fixed to the pipe and retains the liquid within the pipe.

4. The method of claim 3 wherein the blocking device temporarily holds against specified pressure levels thereby allowing the standing wave to be formed, and is expelled from the pipe on increase above the specified pressure levels.

5. The method of claim 4 wherein the blocking device is a sacrificial insert initially positioned in the pipe and is blown from the pipe on increase of pressure after cleaning to thereby enable the pipe to be cleared of the liquid which flows out of the pipe and carries dislodged fouling material with the liquid.

6. The method of claim 5 wherein the inlet end is provided with the pressure pulsations by fitting a nozzle at the inlet end.

7. The method of claim 6 wherein the inlet end is provided with two inlet lines, and one of the inlet lines delivers flowing gas admitted to the pipe, and the other of the inlet lines delivers the incompressible liquid.

8. The method of claim 5 including the step of forming bubbles in the liquid subject to imploding during pressure fluctuations.

9. The method of claim 8 wherein bubbles are collapsed and reformed.

10. A method of cleaning an interior of a fouled pipe comprising the steps of:

(a) in a region of the pipe where the fouling occurs, isolating a portion of the pipe between an inlet end and an outlet end;

(b) filling the pipe between the inlet end and outlet end with an incompressible liquid; and (c) forming microscopic bubbles within the liquid by generating standing waves in the liquid;

(d) applying pressure variations to the liquid so that the bubbles in the liquid are momentarily compressed and released therefrom to thereby initiate collapse of the bubbles to generate vibrations in the liquid for breaking the bond holding the fouling material to the pipe, wherein (i) the vibrations are generated at multiple frequencies, (ii) the frequencies of the vibrations are controlled by the magnitude of the pressure variations, and (iii) the bond is broken by vibrating the fouling material and the pipe at different frequencies.

11. The method of claim 10 including the step of mixing a cleaning abrasive in the liquid prior to applying the pressure variations to the liquid, wherein the interior of the pipe is further cleaned by the cleaning abrasive after the fouling material bond has been broken and fouling material has been removed.

12. The method of claim 10 including the step of mixing a compressible gas with the liquid.

13. The method of claim 10 including the step of controlling temperature of the liquid to thereby control an extent of cleaning in the pipe.

14. The method of claim 10 including the step of blocking the outlet end of the pipe with a pressure controlled blocking device and the blocking device is left fixed in the pipe during cleaning so that liquid and the blocking device are forced by increase of pressure from the pipe at conclusion of the cleaning.

15. The method of claim 14 including the step of pumping added liquid into the pipe after filling with pressure fluctuations.

16. The method of claim 15 further including the step of pumping the added liquid with time dependent pressure fluctuations.

* * * * *